US011838726B2

(12) United States Patent
Goto

(10) Patent No.: US 11,838,726 B2
(45) Date of Patent: Dec. 5, 2023

(54) PRESSURE WAVE-GENERATING DEVICE AND METHOD FOR PRODUCING THE SAME

(71) Applicant: Murata Manufacturing Co., Ltd., Nagaokakyo (JP)

(72) Inventor: Masato Goto, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 0 days.

(21) Appl. No.: 17/574,851

(22) Filed: Jan. 13, 2022

(65) Prior Publication Data

US 2022/0141597 A1 May 5, 2022

Related U.S. Application Data

(63) Continuation of application No. PCT/JP2020/031476, filed on Aug. 20, 2020.

(30) Foreign Application Priority Data

Aug. 30, 2019 (JP) ..... 2019-158290

(51) Int. Cl.
*H04R 7/04* (2006.01)
*H04R 23/00* (2006.01)
*H04R 31/00* (2006.01)

(52) U.S. Cl.
CPC ..... *H04R 23/002* (2013.01); *H04R 7/04* (2013.01); *H04R 31/003* (2013.01)

(58) Field of Classification Search
CPC ..... H04R 23/002; H04R 19/01; H04R 31/003
USPC ..... 381/164
See application file for complete search history.

(56) References Cited

U.S. PATENT DOCUMENTS 5,430,322 A * 7/1995 Koyanagi ..... B64G 1/422 136/211
5,815,921 A * 10/1998 Burward-Hoy ..... H01L 23/3672 29/890.036
7,560,640 B2 * 7/2009 Hu ..... H10N 10/01 136/224
9,601,677 B2 * 3/2017 Siivola ..... H10N 10/17
2010/0054502 A1 3/2010 Miyachi

FOREIGN PATENT DOCUMENTS

JP H11300274 A 11/1999
JP 2005073197 A 3/2005
JP 2009296591 A 12/2009
WO 2008029451 A1 3/2008
WO 2012020600 A1 2/2012

OTHER PUBLICATIONS

International Search Report issued for PCT/JP2020/031476, dated Oct. 27, 2020.
Morrish, R. et al.; "Formation of nanoporous Au by dealloying AuCu thin films in HN03"; Scripta Materialia, May 2011, vol. 64, No. 9, pp. 856-859.
Almond, D.P. et al.; "Photothermal Science and Technicques"; Published by Chapman & Hall, 1996, p. 17.

* cited by examiner

*Primary Examiner* — Suhan Ni
(74) *Attorney, Agent, or Firm* — ArentFox Schiff LLP

(57) ABSTRACT

A pressure wave-generating device having a support and a heating element film that is disposed over the support and that is configured to generate heat by energization, and the heating element film has a porous metal structure.

15 Claims, 6 Drawing Sheets

PRESSURE WAVE-GENERATING DEVICE AND METHOD FOR PRODUCING THE SAME

CROSS REFERENCE TO RELATED APPLICATIONS

The present application is a continuation of International application No. PCT/JP2020/031476, filed Aug. 20, 2020, which claims priority to Japanese Patent Application No. 2019-158290, filed Aug. 30, 2019, the entire contents of each of which are incorporated herein by reference.

FIELD OF THE INVENTION

The present invention relates to a pressure wave-generating device configured to generate a pressure wave by periodically heating air. The present invention also relates to a method for producing a pressure wave-generating device.

BACKGROUND OF THE INVENTION

FIG. 1 is an explanatory diagram illustrating the principle of a pressure wave-generating device. A pressure wave-generating device is also called a thermophone. As an example, a resistor is disposed over a heat-dissipating layer with a heat-insulating layer interposed therebetween. When an electric current flows through the resistor, the resistor generates heat to cause thermal expansion of the air in contact with the resistor. Then, when the current is stopped, the expanded air contracts. This periodic heating generates sound waves. When the drive signal is set to an audible frequency, the device can be used as an acoustic speaker. When the drive signal is set to an ultrasonic frequency, the device can be used as an ultrasonic source. Such thermophones do not have any resonance mechanisms and thus can generate wide-band short-pulse sound waves. Thermophones generate sound waves after converting electrical energy into thermal energy; thus, improvements in energy conversion efficiency and sound pressure are required.

In Patent Document 1, a carbon nanotube structure containing multiple carbon nanotubes arranged parallel to each other is provided as a resistor to increase the surface area in contact with air and reduce the heat capacity per unit area. In Patent Document 2, a silicon substrate is used as a heat-dissipating layer, and porous silicon having low thermal conductivity is used as a heat-insulating layer, thereby improving the heat-insulating characteristics.

PTL 1: Japanese Unexamined Patent Application Publication No. 2009-296591

PTL 2: Japanese Unexamined Patent Application Publication No. 11-300274

PTL 3: International Publication No. 2012/020600

SUMMARY OF THE INVENTION

When carbon nanotubes are used as a resistor, the resistor has a large electrical resistance. Thus, a fairly high drive voltage is required to generate the amount of heat required. This makes it difficult to put the drive circuit into practical use. In addition, carbon nanotubes themselves are quite expensive and difficult to handle.

It is an object of the present invention to provide a pressure wave-generating device having improved sound pressure and suitable electrical resistance. It is another object of the present invention to provide a method for manufacturing such a pressure wave-generating device.

A pressure wave-generating device according to an aspect of the present invention includes a support and a heating element film that is disposed over the support and that is configured to generate heat by energization, the heating element film having a porous metal structure.

A method according to another aspect of the present invention for producing a pressure wave-generating device includes forming a film of an alloy of two or more metals on a support; and dealloying the film of the alloy to remove at least one metal of the two or more metals to form a heating element film having a nanoporous structure.

In the pressure wave-generating device according to the present invention, the heating element film has the porous metal structure and thus has an increased surface area in contact with air to result in improved sound pressure. In addition, the use of the metal material allows the electrical resistance of the heating element film to be set to an appropriate value.

In the method according to the present invention for producing a pressure wave-generating device, it is possible to produce the heating element film having a large surface area in contact with air and appropriate electrical resistance.

BRIEF DESCRIPTION OF THE DRAWINGS

FIG. 2(A) illustrates a plan view, a front view, and a side view, and FIG. 2(B) is a cross-sectional view of a section through an electrode D2.

DETAILED DESCRIPTION OF THE PREFERRED EMBODIMENTS

Figure 1:
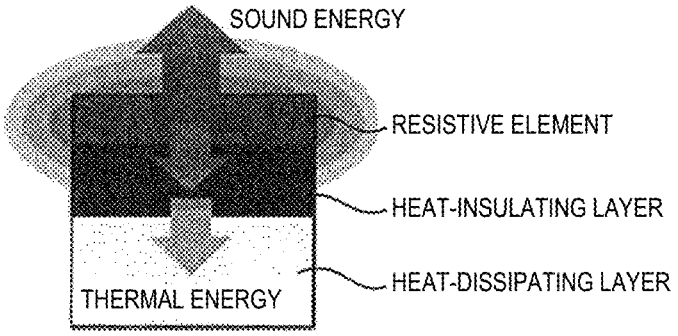
FIG. 1 is an explanatory diagram illustrating the principle of a pressure wave-generating device.

A pressure wave-generating device according to an embodiment of the present invention includes a support and a heating element film that is disposed over the support and that is configured to generate heat by energization, the heating element film having a porous metal structure.

In this configuration, the heating element film has the porous metal structure and thus has an increased surface area in contact with air, thereby resulting in improved sound pressure. The porous structure is configured as an open-cell structure in which local cavities communicate with each other to ensure air permeability between the internal cavity and the external space. Thus, the contact area between the porous structure and air is significantly increased, compared to a non-porous, smooth surface. This can result in a higher efficiency of heat transfer from the heating element film to air to provide improved sound pressure.

The use of the metal material as the heating element film enables the electrical resistance of the heating element film to be easily set to an appropriate value by adjusting the film thickness and selecting the material. Thus, the desired electrical resistance can be obtained to optimize the drive voltage. For example, as compared with carbon nanotubes, material handling is easy, and material cost and circuit cost can be reduced.

The heating element film preferably has a pore diameter (porous diameter) of 24 nm to 130 nm. The "pore diameter" can be defined as the diameter when the area of a pore portion is calculated using image analysis software A-Zou Kun (Asahi Kasei Engineering Corp.) and converted into a perfect circle. A pore diameter of less than 24 nm results in a deterioration in the air permeability between the internal cavity and the external space, thus leading to lower efficiency of heat transfer from the heating element film to air. A pore diameter of more than 130 nm results in a decrease in the surface area of the heating element film in contact with air.

The heating element film preferably has a pore fraction of 50% to 67% by volume, more preferably 50% to 65% by volume. The "pore fraction (voidage)" can be defined as the proportion of the cavity volume to the total volume including the solid portion and the cavity. A pore fraction of less than 50% by volume results in a small specific surface area, insufficient heat exchange with air, and low sound pressure. A pore fraction of more than 67% by volume results in a smaller contact area between the heating element film and the support, resulting in lower adhesion strength.

In the porous metal structure, preferably, the pore fraction is monotonically increased from the support to the pressure wave-generating surface. The smaller pore fraction near a bonding region with the support results in higher adhesion strength between the heating element film and the support. The larger pore fraction near the pressure wave-generating surface of the heating element film results in an increase in the surface area of the heating element film in contact with air.

When the heating element film is divided into a back surface region located on the support side from the thickness center and a front surface region located across the thickness center from the support side, the Pt/Pb ratio of the pore fraction Pt in the front surface region to the pore fraction Pb in the back surface region is preferably 1.02 to 2.00, more preferably 1.03 to 2.00. A Pt/Pb ratio of less than 1.02 results in higher sound pressure but lower adhesion strength to the support. A Pt/Pb ratio of more than 2.00 results in higher adhesion strength to the support but lower sound pressure.

The heating element film preferably has a thickness of 25 nm to 1,000 nm.

In this configuration, the heating element film can have appropriate electrical resistance, thereby optimizing the drive voltage. When the heating element film has a thickness of less than 25 nm, the electrical resistance is high; thus, the drive voltage is too high. When the heating element film has a thickness of 1,000 nm, heat accumulates easily inside, and heat exchange with air is insufficient, thus resulting in low sound pressure.

Preferably, the support includes a substrate and a heat-insulating layer that is disposed over the substrate and that has a lower thermal conductivity than the substrate.

In this configuration, the presence of the heat-insulating layer can suppress the dissipation of heat from the heating element film to the substrate. This results in high efficiency of heat transfer from the heating element film to air, leading to improved sound pressure.

The heat-insulating layer preferably has a thermal conductivity of 1.4 W/(m·K) or less.

This configuration can suppress the dissipation of heat from the heating element film to the substrate. This results in high efficiency of heat transfer from the heating element film to air, thus leading to improved sound pressure. A thermal conductivity of more than 1.4 W/(m·K) results in more heat dissipation from the heating element film to the substrate.

The heating element film is preferably composed of two or more metals.

In this configuration, a porous structure can be easily produced by forming the heating element film composed of two or more metals.

The proportion of the major element in the two or more metals is preferably 50 to 95 at %.

In this configuration, the proportion of major element is 50 to 95 at %, thus resulting in improved adhesion between the heating element film and the support.

A method for producing a pressure wave-generating device according to the present invention includes: providing a support; forming a film of an alloy of two or more metals; and subjecting the film of the alloy to dealloying to remove at least one metal to form a heating element film having a nanoporous structure.

In this configuration, the nanoporous structure can be formed in the heating element film. This facilitates the production of the heating element film having a large surface area in contact with air and appropriate electrical resistance. "Dealloying" and "nanoporous structure" will be described below.

(Pressure Wave-Generating Device)

Figure 2A:
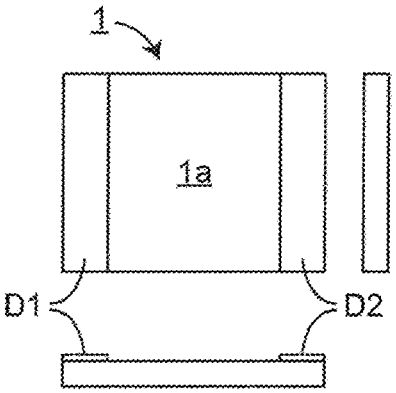
FIGS. 2(A) and 2(B) illustrate an example of a pressure wave-generating device 1 according to an embodiment of the present invention, where
Figure 2B:
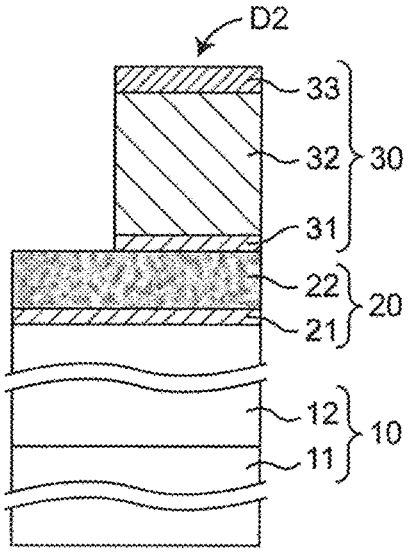

FIG. 2 illustrates an example of a pressure wave-generating device 1 according to an embodiment of the present invention, FIG. 2(A) illustrates a plan view, a front view, and a side view, and FIG. 2(B) is a cross-sectional view of a section through an electrode D2.

The pressure wave-generating device 1 includes a support 10, a heat-generating layer 20, and an electrode structure 30. The support 10 includes a substrate 11 and a heat-insulating layer 12. The substrate 11 is composed of a semiconductor, such as silicon, or an electrical insulator, such as glass, ceramic, or polymer.

The heat-insulating layer 12 is disposed on the substrate 11. The heat-insulating layer 12 is composed of an electrical insulator, such as an oxide, nitride, oxynitride, glass, ceramic, or polymer of a metal or semiconductor. An oxide formed on a surface of the substrate 11 may also be used. The heat-insulating layer 12 preferably has a lower thermal conductivity than the substrate 11, thereby suppressing the dissipation of heat from the heating element film 20 to the substrate 11. This results in a higher efficiency of heat transfer from the heating element film 20 to air, thereby leading to improved sound pressure. The heat-insulating layer 12 may be omitted if necessary.

The heat-generating layer 20 is disposed on the support 10. The heat-generating layer 20 includes an underlying film 21 and a heating element film 22. The heating element film 22 is composed of an electrically conductive material and is electrically driven to generate heat by the passage of an electric current, thereby radiating pressure waves resulting from the periodic expansion and contraction of air from a pressure wave-generating surface 1*a*.

The underlying film 21 has the function of improving the adhesion strength between the support 10 and the heating element film 22. The underlying film 21 may be omitted if necessary.

A pair of electrodes D1 and D2 are disposed on respective opposed sides of the heat-generating layer 20. Each of the electrodes D1 and D2 has the electrode structure 30 including electrode layers 31 to 33. Although three-layer electrode structure is illustrated here, a structure with one, two, or four or more layers can also be used.

The dimensions of the pressure wave-generating device 1 are, for example, 4 mm long×5 mm wide×0.5 mm high. The dimensions of the electrodes D1 and D2 are, for example, 4 mm×0.8 mm. These dimensions can be changed as needed.

In this embodiment, the heating element film 22 has a porous metal structure and thus has an increased surface area in contact with air, resulting in an improved sound pressure. The use of the metal material as the heating element film 22 enables the electrical resistance of the heating element film 22 to be easily set to an appropriate value by adjusting the film thickness and selecting the material.

The heating element film 22 is preferably composed of an alloy containing two or more metals, such as metal materials, e.g., Au, Ag, Cu, Pt, Rh, Pd, Fe, Co, Ni, Cr, Mo, W, Ti, Al, Zn, Ir, and Ta. The proportion of the major element in the two or more metals is preferably 50 to 95 at %.

(Method for Producing a Pressure Wave-Generating Device)

Figure 9:
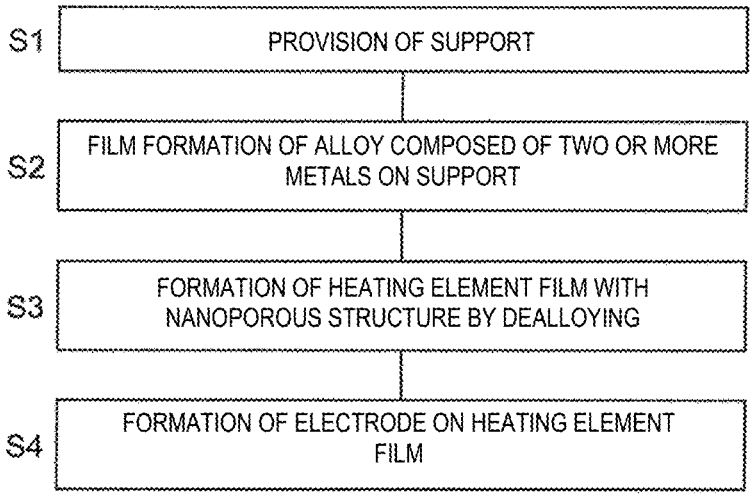
FIG. 9 is a flow chart of an example of a method for producing a pressure wave-generating device.

FIG. 9 is a flow chart of an example of a method for producing a pressure wave-generating device. In step S1, the support 10 is provided. As illustrated in FIG. 2, the support 10 may include the substrate 11 and the heat-insulating layer 12, or may be formed of the substrate 11 alone.

In step S2, after the underlying film 21 is formed on the support 10, a film of an alloy composed of two or more metals is formed. Examples of a film-forming method that can be employed include vapor deposition, sputtering, electroplating, electroless plating, application, sintering, and annealing. As materials for the metals, those mentioned above can typically be used. Examples of metal materials that can be used to form a nanoporous structure by dealloying include Au, Ag, Cu, Pt, Pd, and Ni.

In step S3, dealloying is performed to remove at least one metal from the formed alloy film to form the heating element film 22 having a nanoporous structure. Examples of a dealloying method that can be employed include dissolution using an acidic solution, such as nitric acid, sulfuric acid, or hydrogen fluoride; and electrolysis.

In step S4, the pair of electrodes D1 and D2 is formed on the resulting heating element film 22. Examples of a method that can be used to form the electrode films include vapor deposition, sputtering, electroplating, electroless plating, and application. Examples of an electrode material that can be used include Au, Ag, Cu, Pt, Rh, Pd, Ru, Ni, Ir, Cr, Mo, W, Ti, and Al.

Figure 3:
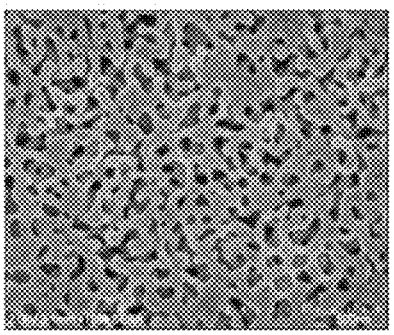
FIG. 3 is a SEM image of a nanoporous structure formed by dealloying of a AuCu alloy.

FIG. 3 is an image, taken with a scanning electron microscope (SEM), of a nanoporous structure formed by dealloying of a AuCu alloy. The nanoporous structure is characterized by having a larger specific surface area than a non-porous, smooth surface. Thus, when the heating element film 22 has a nanoporous structure, a large surface area of the heating element film 22 in contact with air is obtained. This promotes heat exchange with air to improve the sound pressure. Since the heating element film 22 is composed of the metal materials, the electrical resistance in an appropriate range can be easily obtained.

EXAMPLES

Example 1

(Sample Preparation Method)

A pressure wave-generating device was produced by the following method. A Si wafer with a 15-μm-thick $SiO_2$ film on its surface (KST World Co., Ltd.) was used as a substrate. The Si wafer had a thickness of 0.675 mm. $SiO_2$ has a lower thermal conductivity than Si and thus was used as a heat-insulating layer. The above substrate may be a substrate other than a Si substrate. The prepared substrate is cut into 4 mm in length and 5 mm in width with a dicing machine in order to facilitate handling in the subsequent process.

As a heat-generating layer, a Ti film (10 nm thick) was formed by vapor deposition. Then the vapor deposition of Au and the vapor deposition of Cu were alternately repeated four times to form a multilayer film of Au (35 nm thick)/Cu (75 nm thick)/Au (35 nm thick)/Cu (75 nm thick)/Au (35 nm thick)/Cu (75 nm thick)/Au (35 nm thick)/Cu (75 nm thick). The vapor-deposited sample was heat-treated by maintaining the sample at 350° C. for 2 hours in a reducing atmosphere to give a AuCu alloy.

The alloyed sample was dealloyed by immersing the sample in 60% nitric acid for 20 minutes at room temperature to leach Cu from the AuCu alloy, thereby forming a nanoporous structure composed of undissolved Au.

Figure 4:
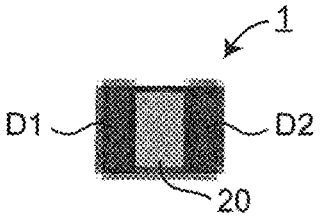
FIG. 4 is a plan view of a pressure wave-generating device according to Example 1.

An electrode measuring 4 mm×0.8 mm was formed on each side of the heat-generating layer. Each of the electrodes had a three-layer structure including Ti (10 nm thick), Cu (500 nm thick), and Au (100 nm thick) from the bottom. FIG. 4 is a plan view of the resulting pressure wave-generating device. As a reference sample for comparison, a pressure wave-generating device was produced, in which the heat-generating layer was formed of Ti (10 nm thick)/non-porous Au (40 nm thick). Except for the heat-generating layer, the substrate and the electrodes used were the same as described above.

(Evaluation Method)

For the electrical characteristics of the device, the resistance was measured by the four-point method at room temperature using a digital multimeter (Agilent 34401A). For the evaluation of sound pressure, a MEMS microphone (Knowles: SPU0410LR5H) was used. The distance between the device and the microphone was 6 cm. The sound pressure was monitored using the output voltage of the microphone (frequency: 60 kHz).

Figure 5:
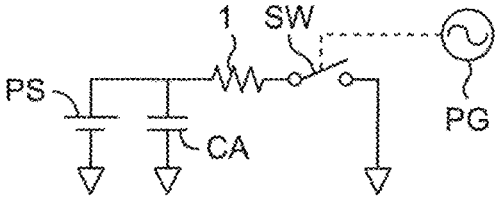
FIG. 5 is a circuit diagram illustrating an example of an evaluation circuit.

FIG. 5 is a circuit diagram illustrating an example of an evaluation circuit. A series circuit of the pressure wave-generating device 1 and a switching element SW (for example, FET) was provided between the output of a DC power supply PS and the ground. The switching element SW was driven by a pulse wave having a frequency of 60 kHz using a pulse generator PG. The applied voltage was 6 to 24 V. A capacitor CA (for example, 3,300 μF) was connected in parallel with the DC power supply PS.

In the pressure wave-generating device, heat conduction from the heat-generating layer to air results in thermal expansion of air to generate sound waves. Thus, a higher power input for the same element results in a higher sound pressure. To evaluate whether the system can generate sound waves efficiently, it is necessary to compare the sound pressures at the same power.

As an input power to the thermophone is increased, the microphone output also increases linearly. When the acoustic conversion efficiency is satisfactory, a large rate of an increase in microphone output ΔV to an increment in power ΔW is obtained. Here, ΔV/ΔW (sound pressure slope) is used as an index of sound pressure. The above-described non-porous reference sample was used for comparison.

To measure the thickness of each heat-generating layer, the cross-sectional observation of each of the produced pressure wave-generating devices was performed. The sample used for the cross-sectional observation was prepared by FIB processing using FEI Helios Nanorab 600i.

Figure 6:
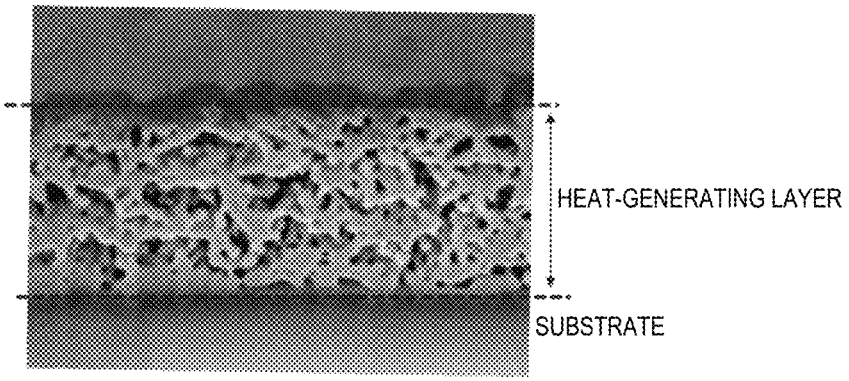
FIG. 6 is a SEM image of a cross section of the pressure wave-generating device according to Example 1.

FIG. 6 is a SEM image of a cross section of the pressure wave-generating device. The cross-sectional observation was performed with a scanning electron microscope (S-4800, available from Hitachi, Ltd., acceleration voltage: 3 kV, magnification: ×30 k). The cross section was uneven because of the porous structure; thus, the thickness was defined as the thickness of a portion with the maximum thickness (indicated by dashed lines).

Table 1 presents a change in the acoustic conversion efficiency (slope of the graph) in accordance with the presence or absence of the nanoporous structure. The evaluation was performed in three grades (○: a sound pressure slope of more than 1.0 and a resistance of 100Ω or less; Δ: a sound pressure slope of more than 1.0 and a resistance of more than 100Ω; and x: a sound pressure slope of 1.0 or less).

TABLE 1

| Sample No. | Underlying film | Heat-generating layer | Thickness of heat-generating layer | Resistance Ω | Sound pressure slope | Evaluation |
|---|---|---|---|---|---|---|
| 1 | Ti: 10 nm | non-porous Au | 40 | 0.58 | 1 | — |
| 2 | Ti: 10 nm | porous Au | 400 | 0.71 | 2.1 | ○ |

Compared to the reference sample containing the heat-generating layer (Ti (10 nm thick)/non-porous Au (40 nm thick)), the case where the sound pressure slope was greater than 1.0 was evaluated as ○. The upper limit of the resistance value was set at 100Ω. As mentioned above about ΔV/ΔW (sound pressure slope), a greater power input to the device results in a higher sound pressure. The power consumption is expressed by $V^2/R$ (V: voltage, and R: resistance). For example, when 10 V is applied to a 1-Ω device, the power is $10^2/1=100$ W. When the same power is applied to a 100-Ω device, a voltage of 100 V needs to be applied ($100^2/100=100$ W). When such devices are assumed to be incorporated into electronic apparatuses, only limited apparatuses can apply a voltage of 100 V or higher. For this reason, the upper limit of the resistance was set at 100Ω. It can be seen that this prototype device (No. 2) has almost the same resistance as the reference sample (No. 1) and has a large sound pressure slope of 2.1.

The formation of the metal film having the nanoporous structure with a large surface area as the heat-generating layer facilitates heat exchange with air and is effective in increasing the sound pressure. The metal film can be formed directly on the substrate and thus is easily handled, compared with carbon nanotubes. Since the heat-generating layer can be composed of the metal, the resistance can be lowered.

Example 2

(Sample Preparation Method)

In Example 1, the evaluation was performed in accordance with the presence or absence of the nanoporous structure. Here, pressure wave-generating devices including heat-generating layers having different thicknesses were prototyped. As in Example 1, the prepared substrate was cut into 4 mm in length and 5 mm in width. As each of the heat-generating layers, a Ti film (10 nm thick) was formed by vapor deposition, and then a Au/Cu film was formed under vapor deposition conditions given in Table 2. The vapor-deposited samples were heat-treated by maintaining the samples at 350° C. for 2 hours in a reducing atmosphere to give a AuCu alloy. The process subsequent to the heat treatment was the same as in Example 1.

Table 2 presents a change in the acoustic conversion efficiency at different thicknesses of the heat-generating layer. In the vapor deposition conditions, for example, "Au: 35 nm/Cu: 75 nm×4" indicates a four-period structure of Au (35 nm thick)/Cu (75 nm thick), and "Au: 7 nm/Cu: 15 nm×1" indicates a single-period structure of Au (7 nm thick)/Cu (15 nm thick). The evaluation was performed in three grades as in Example 1.

TABLE 2

| Sample No. | Vapor deposition conditions for heat-generating layer | Thickness of heat-generating layer nm | Resistance Ω | Sound pressure slope | Evaluation |
|---|---|---|---|---|---|
| 3 | Au: 7 nm/ Cu: 15 nm × 1 | 20 | 105.3 | 2.9 | Δ |
| 4 | Au: 8.8 nm/ Cu: 18.8 nm × 1 | 25 | 46.1 | 2.9 | ○ |
| 5 | Au: 17.5 nm/ Cu: 37.5 nm × 1 | 50 | 7.5 | 2.8 | ○ |
| 6 | Au: 35 nm/ Cu: 75 nm × 1 | 100 | 2.7 | 2.5 | ○ |
| 2 | Au: 35 nm/ Cu: 75 nm × 4 | 400 | 0.71 | 2.1 | ○ |
| 7 | Au: 35 nm/ Cu: 75 nm × 10 | 1000 | 0.40 | 1.6 | ○ |
| 8 | Au: 35 nm/ Cu: 75 nm × 20 | 2000 | 0.25 | 1.0 | x |

Compared to the reference sample containing the heat-generating layer (Ti (10 nm thick)/non-porous Au (40 nm thick)), the sound pressure slope was larger than 1.0 when the thickness of the heat-generating layer was 1,000 nm or less. When the film thickness is large, heat accumulates easily inside, and heat exchange with air is insufficient, thus resulting in low sound pressure. For this reason, a smaller thickness of the heat-generating layer is more advantageous for the conditions of high sound pressure. However, a smaller thickness of the heating layer results in a higher resistance. A film thickness of 25 nm or more is required to achieve 100Ω or less. It can also be seen that the resistance can be adjusted by changing the thickness of the heat-generating layer.

As described in Example 1, a greater power input ($V^2/R$) results in a higher sound pressure. For example, in the case where a necessary sound pressure is obtained at an instantaneous power of 100 W, a necessary power can be input by adjusting the resistance to 1Ω when the voltage of the electronic apparatus into which the device is installed is 10 V, or to 4Ω when the voltage is 20 V. In the case where the resistance is not adjustable, when the resistance is higher than a necessary resistance, the sound pressure is insufficient (for example, when the resistance is doubled, the sound pressure is ½), and when the resistance is lower than the necessary resistance, the power is high (for example, when the resistance is ½, the power is doubled).

This can also be handled by voltage adjustment on the apparatus side. However, an additional component, such as a DC-DC converter, is required to adjust the voltage, thus increasing the cost and size.

The thickness of the heat-generating layer is preferably 1,000 nm or less, thus facilitating the heat exchange with air to increase the sound pressure. To achieve both high sound pressure and low resistance, the film thickness is preferably 25 nm or more.

Example 3

(Sample Preparation Method)

In Examples 1 and 2, the heat-insulating layers were composed of $SiO_2$. Here, pressure wave-generating devices including heat-insulating layers composed of different materials were prototyped. In a sample, a Si substrate with only a natural oxide film ($SiO_2$) on a surface was used as a substrate without a heat-insulating layer ($SiO_2$) and cut into 4 mm in length and 5 mm in width. In another sample, the above Si substrate to which a polyimide film (Kapton Sheet H-200, available from Du Pont-Toray Co., Ltd.) serving as a heat-insulating layer was attached was provided. After the heat-insulating layer was formed, a heat-generating layer and electrodes were formed in the same way as in Example 1.

Table 3 presents a change in acoustic conversion efficiency when the heat-insulating layer was changed. The evaluation was performed in three grades as in Example 1. With respect to values of the thermal conductivity, reference was made to literature (D. P. Almond and P. M. Patel: Photothermal Science and Techniques (Chapman & Hall, 1996) p. 17) for silicon and $SiO_2$, and to the manufacturer's catalog value for polyimide. The thermal conductivity of a Si wafer is 148 W/(m·K), which is larger than $SiO_2$.

TABLE 3

| Sample No. | Heat-insulating layer | Thermal conductivity W/(m · K) | Resistance Ω | Sound pressure slope | Evaluation |
|---|---|---|---|---|---|
| 9 | no (Si substrate) | 148 | 0.69 | 0.5 | x |

TABLE 3-continued

| Sample No. | Heat-insulating layer | Thermal conductivity W/(m · K) | Resistance Ω | Sound pressure slope | Evaluation |
|---|---|---|---|---|---|
| 2 | SiO2 | 1.4 | 0.71 | 2.1 | ○ |
| 10 | polyimide | 0.16 | 1.5 | 3.8 | ○ |

In sample No. 9, the sound pressure slope was 0.5. The sound pressure slope of sample No. 10 including the heat-insulating layer composed of polyimide having low thermal conductivity was larger than that of sample No. 2 including $SiO_2$. Considering the evaluation results, the thermal conductivity of the heat-insulating layer is preferably 1.4 W/(m·K) or less.

The use of the heat-insulating layer having a lower thermal conductivity than the substrate enables prevention of heat escaping to the substrate when heat is generated, resulting in efficient heat conduction to air and higher sound pressure.

Example 4

(Sample Preparation Method)

Pressure wave-generating devices were produced by the following method. A Si wafer with a 15-μm-thick $SiO_2$ film on its surface (KST World Co., Ltd.) was used as a substrate. The Si wafer had a thickness of 0.675 mm. $SiO_2$ has a lower thermal conductivity than Si and thus was used as a heat-insulating layer. The above substrate may be a substrate other than a Si substrate. The prepared substrate is cut into 4 mm in length and 5 mm in width with a dicing machine in order to facilitate handling in the subsequent process.

As a heat-generating layer, a Ti film (10 nm thick) was formed by vapor deposition. Then the vapor deposition of Au and the vapor deposition of Cu were alternately repeated four times to form a multilayer film of Au (35 nm thick)/Cu (75 nm thick)/Au (35 nm thick)/Cu (75 nm thick)/Au (35 nm thick)/Cu (75 nm thick)/Au (35 nm thick)/Cu (75 nm thick). The vapor-deposited sample was heat-treated by maintaining the sample at 350° C. for 2 hours in a reducing atmosphere to give a AuCu alloy.

Each alloyed sample was dealloyed by immersing the sample in 60% nitric acid for 0 to 60 minutes at room temperature to leach Cu from the AuCu alloy, thereby forming a nanoporous structure composed of undissolved Au.

An electrode measuring 4 mm×0.8 mm was formed on each side of the heat-generating layer. Each of the electrodes had a three-layer structure including Ti (10 nm thick), Cu (500 nm thick), and Au (100 nm thick) from the bottom.

(Evaluation Method)

A tape peeling test was performed to evaluate the adhesion strength. In the case where even a portion of the heat-generating layer or electrodes peeled off after the test, the sample was evaluated as defective. To analyze the composition of the surface of the heat-generating layer, SEM-EDX analysis was performed with a scanning electron microscope (SU-8040, available from Hitachi Ltd., acceleration voltage: 10 kV, magnification: ×30 k) and EDX (EMAX-Evolution, available from Horiba Ltd). The nitric acid immersion (dealloying) time and the Au/Cu ratio were examined.

Table 4 presents the comparative results in the tape peeling test. The evaluation was performed in three grades (○: the sample had a sound pressure slope of more than 1.0 and was not peeled by the tape peeling test; Δ: the sample had a sound pressure slope of more than 1.0 and was peeled by the tape peeling test; and x: the sample had a sound pressure slope of 1.0 or less).

Figure 7:
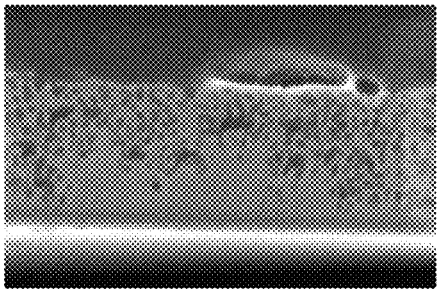
FIG. 7 is a SEM image of a cross section of sample No. 12 according to Example 4.

FIG. 7 is a SEM image of a cross section of sample No. 12 (which was not peeled by the tape peeling test). As illustrated in FIG. 7, in the nanoporous structure of the heat-generating layer, preferably, the voidage is monotonically increased from the support to the pressure wave-generating surface. The low voidage near a bonding region with the substrate can increase the adhesion strength between the heat-generating layer and the substrate. The high voidage near the pressure wave-generating surface of the heat-generating layer results in a large surface area of the heat-generating layer in contact with air.

Figure 8:
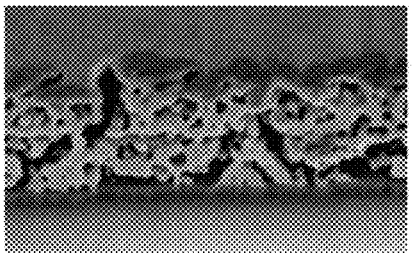
FIG. 8 is a SEM image of a cross section of sample No. 14 according to Example 4.

FIG. 8 is a SEM image of a cross section of sample No. 14 (which was peeled by the tape peeling test). As illustrated in FIG. 8, when the voidage is high also in a portion near the substrate, the contact area between the heat-generating layer and the substrate is small, resulting in low adhesion strength.

TABLE 4

| Sample No. | Immersion time in nitric acid min | Au/ (Au + Cu) at. % | Resistance Ω | Sound pressure slope | Evaluation |
|---|---|---|---|---|---|
| 11 | 0 | 25% | 0.35 | 0.8 | x |
| 12 | 5 | 50% | 0.51 | 1.6 | ○ |
| 2 | 20 | 76% | 0.71 | 2.1 | ○ |
| 13 | 40 | 95% | 0.80 | 2.5 | ○ |
| 14 | 60 | 97% | 0.82 | 2.4 | Δ |

In sample No. 11, which was not immersed in nitric acid (immersion time: 0 min), Cu did not leach out, and thus no porous structure was formed, resulting in low sound pressure. In sample No. 14, in which Au was 97 at %, the sound pressure was high, but the sample was peeled by the tape peeling test. Accordingly, the sample was evaluated as A.

A Au proportion of 50 to 95 at % results in a high sound pressure because of the porous structure and also results in good adhesion strength of the heat-generating layer.

Example 5

(Sample Preparation Method)

Pressure wave-generating devices were produced in the same manner as in Example 1. Here, nanoporous structures having various pore diameters were formed by changing the dealloying conditions, such as immersion temperature in nitric acid and immersion time in nitric acid. A Si wafer with a 15-μm-thick $SiO_2$ film on its surface (KST World Co., Ltd.) was used as a substrate. The Si wafer had a thickness of 0.675 mm. $SiO_2$ has a lower thermal conductivity than Si and thus was used as a heat-insulating layer. The above substrate may be a substrate other than a Si substrate. The prepared substrate is cut into 4 mm in length and 5 mm in width with a dicing machine in order to facilitate handling in the subsequent process.

As a heat-generating layer, a Ti film (10 nm thick) was formed by vapor deposition. Then the vapor deposition of Au and the vapor deposition of Cu were alternately repeated four times to form a multilayer film of Au (35 nm thick)/Cu (75 nm thick)/Au (35 nm thick)/Cu (75 nm thick)/Au (35 nm thick)/Cu (75 nm thick)/Au (35 nm thick)/Cu (75 nm thick). The vapor-deposited sample was heat-treated by maintaining the sample at 350° C. for 2 hours in a reducing atmosphere to give a AuCu alloy.

The alloyed samples were dealloyed by immersion in 60% nitric acid having a temperature of 3° C. to 40° C. for 3 to 90 minutes at room temperature to leach Cu from the AuCu alloy, thereby forming nanoporous structures having different pore diameters and being composed of undissolved Au. Different pore diameters were obtained in accordance with the immersion temperature in nitric acid and the immersion time in nitric acid.

An electrode measuring 4 mm×0.8 mm was formed on each side of the heat-generating layer. Each of the electrodes had a three-layer structure including Ti (10 nm thick), Cu (500 nm thick), and Au (100 nm thick) from the bottom. FIG. 4 is a plan view of the resulting pressure wave-generating device. As a reference sample for comparison, a pressure wave-generating device was produced, in which the heat-generating layer was formed of Ti (10 nm thick)/non-porous Au (40 nm thick). Except for the heat-generating layer, the substrate and the electrodes used were the same as described above.

(Evaluation Method)

Figure 10:
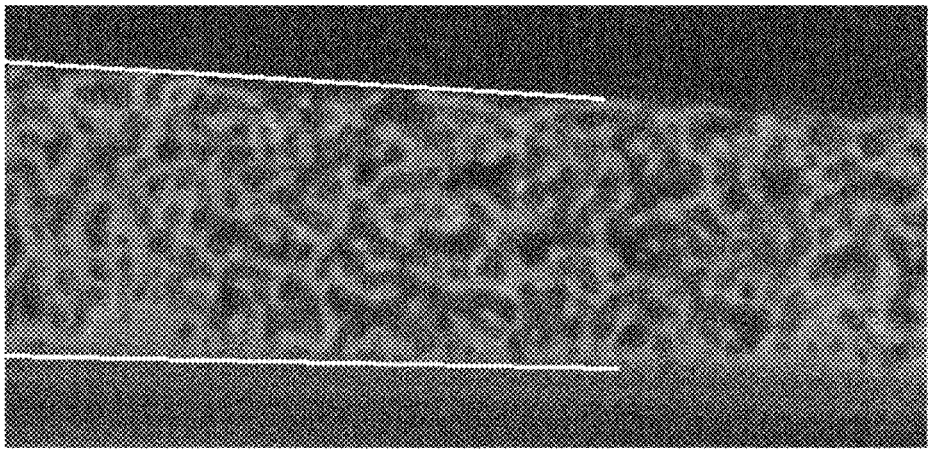
FIG. 10 is a SEM image of a cross section of a heat-generating layer.
Figure 11:
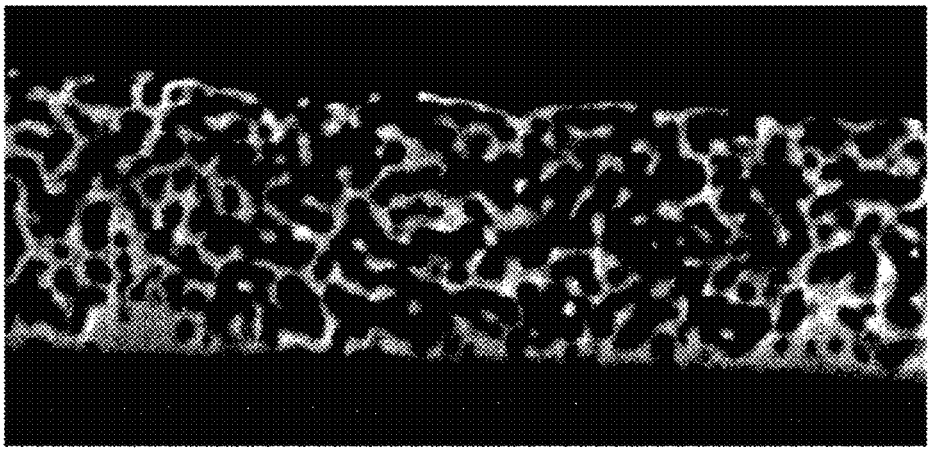
FIG. 11 is a binarized diagram of the cross-sectional view of FIG. 10.

To measure the pore diameter of each heat-generating layer, the cross-sectional observation of each of the produced pressure wave-generating devices was performed. The cross-sectional observation was performed with a scanning electron microscope (S-4800, available from Hitachi, Ltd., acceleration voltage: 3 kV, magnification: ×30 k). FIG. 10 is a SEM image of a cross section of the heat-generating layer. FIG. 11 is a binarized diagram of the cross-sectional view in FIG. 10, with the contrast emphasized to distinguish the pore portions and the metal portions of the heat-generating layer. The pore diameter can be defined as the diameter when the area of a pore portion is calculated using image analysis software A-Zou Kun (Asahi Kasei Engineering Corp.) and converted into a perfect circle.

Table 5 presents the comparative results of the characteristic evaluation when the heat-generating layers had different pore diameters. The evaluations of the resistance and the sound pressure are the same as in Example 1. The evaluation was performed in three grades (○: a sound pressure slope of more than 1.0 and a resistance of 100Ω or less; Δ: a sound pressure slope of more than 1.0 and a resistance of more than 100Ω; and x: a sound pressure slope of 1.0 or less).

TABLE 5

| Sample No | Immersion temperature in nitric acid ° C. | Immersion time in nitric acid min | Pore diameter nm | Resistance Ω | Sound pressure slope | Evaluation |
|---|---|---|---|---|---|---|
| 15 | 3 | 90 | 21.7 | 1.21 | 0.9 | x |
| 16 | 5 | 75 | 25.3 | 1.08 | 1.1 | ○ |
| 17 | 10 | 60 | 31.6 | 0.95 | 1.4 | ○ |
| 2 | 25 | 20 | 58.1 | 0.71 | 2.1 | ○ |
| 18 | 30 | 10 | 85.6 | 0.63 | 1.9 | ○ |
| 19 | 35 | 5 | 126 | 0.59 | 1.2 | ○ |
| 20 | 40 | 3 | 160 | 0.61 | 0.9 | x |

Compared to the reference sample (heat-generating layer Ti: 10 nm, Au: 40 nm), the case where the sound pressure slope was greater than 1.0 was evaluated as ○. The upper limit of the resistance value was set at 100Ω. In the pressure wave-generating device, a greater power input results in a higher sound pressure. The power consumption is expressed by $V^2/R$ (V: voltage, and R: resistance). For example, when 10 V is applied to a 1·Ω device, the power is $10^2/1=100$ W. When the same power is applied to a 100-Ω device, a voltage of 100 V needs to be applied ($100^2/100=100$ W). When such devices are assumed to be incorporated into electronic apparatuses, only limited apparatuses can apply a voltage of 100 V or higher. For this reason, the upper limit of the resistance was set at 100Ω.

The prototype devices (Nos. 2 and 16 to 19) produced here had pore diameters ranging from 24 to 130 nm, resulting in samples with high sound pressure. A pore diameter of less than 24 nm results in low air permeability between the inner cavity and the outer space and low efficiency of heat transfer from the heating element film to air. A pore diameter of more than 130 nm results in a small surface area of the heating element film in contact with air and thus low transfer efficiency to air in the porous structure.

The formation of the metal film having the nanoporous structure with a large surface area facilitates heat exchange with air and is effective in increasing the sound pressure. The sound pressure efficiency is particularly high when the pore diameter is 24 to 130 nm.

Example 6

(Sample Preparation Method)

Here, pressure wave-generating devices having different pore fractions were prototyped. As in Example 5, the prepared substrate was cut into 4 mm in length and 5 mm in width. As the heat-generating layers, Ti films (10 nm thick) were formed by vapor deposition, and then Au/Cu films having different Au/Cu ratios were formed in accordance with the deposition conditions given in Table 6. The vapor-deposited samples were heat-treated by maintaining the samples at 350° C. for 2 hours in a reducing atmosphere to give a AuCu alloy.

Each alloyed sample was dealloyed by immersing the sample in 60% nitric acid for 20 minutes at room temperature to leach Cu from the AuCu alloy, thereby forming a nanoporous structure composed of undissolved Au.

An electrode measuring 4 mm×0.8 mm was formed on each side of the heat-generating layer. Each of the electrodes had a three-layer structure including Ti (10 nm thick), Cu (500 nm thick), and Au (100 nm thick) from the bottom.

(Evaluation Method)

The evaluations of the resistance and the sound pressure are the same as in Example 1. A tape peeling test was performed to evaluate the adhesion strength. In the case where even a portion of the heat-generating layer or electrodes peeled off after the test, the sample was evaluated as defective.

Figure 12:
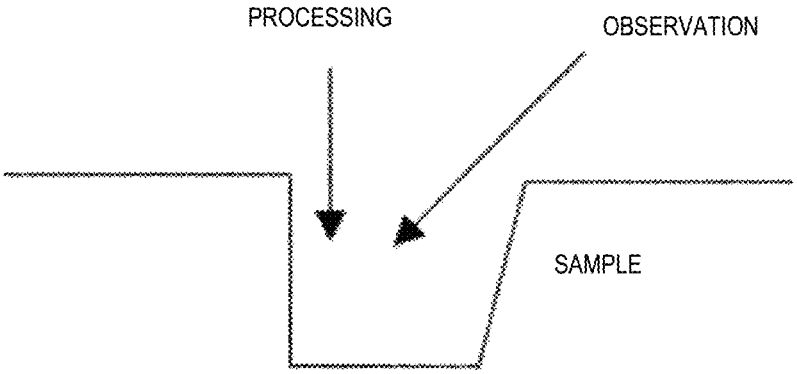
FIG. 12 is an explanatory diagram of an FIB process and the observation direction of a SEM image.

To observe the cross-section of the heat-generating layer, FIB processing was performed with FEI Helios Nanorab 660i as illustrated in FIG. 12, and SEM images were observed. Subsequently, FIB processing was performed again by 10 nm in the depth direction (left direction in FIG. 12), and then the SEM image was observed. These FIB processing and SEM observation were repeated to obtain SEM images with a depth of 400 nm (41 images in total). A three-dimensional image of the heat-generating layer was formed from these 41 SEM images, and the pore fraction was calculated.

Table 6 presents the comparison results of the sound pressure at different pore fractions (○: the sample had a sound pressure slope of more than 1.0 and was not peeled by the tape peeling test; Δ: the sample had a sound pressure slope of more than 1.0 and was peeled by the tape peeling test; and x: the sample had a sound pressure slope of 1.0 or less).

TABLE 6

| Sample No. | Vapor deposition conditions for heat-generating layer | Pore fraction vol % | Resistance Ω | Sound pressure slope | Evaluation |
|---|---|---|---|---|---|
| 21 | Au: 50 nm/ Cu: 60 nm × 4 | 43.7% | 0.47 | 0.9 | x |
| 22 | Au: 45 nm/ Cu: 65 nm × 4 | 50.1% | 0.53 | 1.2 | ○ |
| 2 | Au: 35 nm/ Cu: 75 nm × 4 | 58.9% | 0.71 | 2.1 | ○ |
| 23 | Au: 25 nm/ Cu: 85 nm × 4 | 63.4% | 1.8 | 2.7 | ○ |
| 24 | Au: 22 nm/ Cu: 88 nm × 4 | 65.1% | 2.8 | 2.9 | ○ |
| 25 | Au: 20 nm/ Cu: 90 nm × 4 | 66.2% | 3.2 | 3.1 | Δ |

Compared to the reference sample (heat-generating layer Ti: 10 nm, Au: 40 nm), the sound pressure slope was smaller than 1.0 when the pore fraction was less than 50% by volume. A small pore fraction results in a small specific surface area and insufficient heat exchange with air, leading to low sound pressure. However, a larger pore fraction results in lower adhesion strength to the substrate; thus, a pore fraction of 65% or less is desirable.

Accordingly, a pore fraction of 50% to 67% by volume results in easy heat exchange with air and high sound pressure. To achieve both high sound pressure and adhesion strength, a pore fraction of 65% or less by volume is preferred.

Example 7

(Sample Preparation Method)

Pressure wave-generating devices were produced in the same manner as in Example 4 above.

(Evaluation Method)

The evaluations of the resistance and the sound pressure are the same as in Example 1. A tape peeling test was performed to evaluate the adhesion strength. In the case where even a portion of the heat-generating layer or electrodes peeled off after the test, the sample was evaluated as defective. To analyze the composition of the surface of the heat-generating layer, SEM-EDX analysis was performed with a scanning electron microscope (SU-8040, available from Hitachi Ltd., acceleration voltage: 10 kV, magnification: ×30 k) and EDX (EMAX-Evolution, available from Horiba Ltd). The nitric acid immersion (dealloying) time and the Au/Cu ratio were examined.

To observe the cross-section of the heat-generating layer as in Example 6, FIB processing was performed with FEI Helios Nanorab 660i, and SEM images were observed. Subsequently, FIB processing was performed again by 10 nm in the depth direction (left direction in FIG. 12), and then the SEM image was observed. These FIB processing and SEM observation were repeated to obtain SEM images with a depth of 400 nm (41 images in total). A three-dimensional image of the heat-generating layer was formed from these 41 SEM images, and the pore fraction was calculated.

Figure 13:
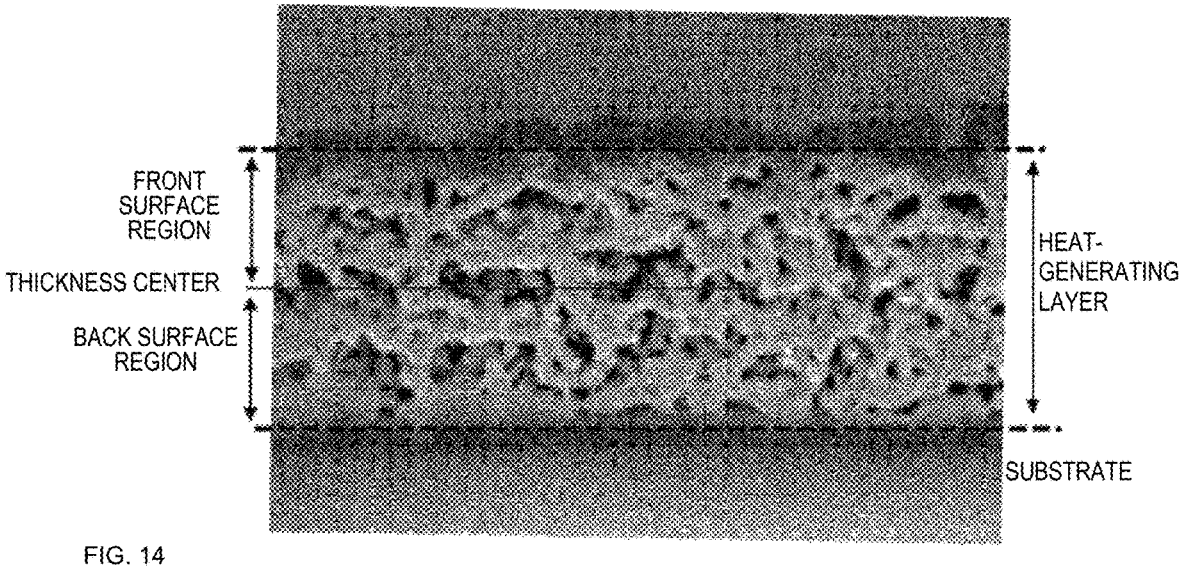
FIG. 13 is a SEM image of a cross section of a heat-generating layer.

FIG. 13 is a SEM image of a cross section of a heat-generating layer. The heat-generating layer has a porous structure and thus has unevenness on its front surface and back surface. For this reason, the thickness was defined as the thickness of a portion with the maximum thickness. The position where the film thickness was half was defined as the thickness center. The heat-generating layer is divided into a back surface region located on the substrate side from the thickness center and a front surface region located across the thickness center from the substrate side. The pore fraction Pt in the front surface region and the pore fraction Pb in the back surface region were calculated, and the Pt/Pb ratio was calculated.

Table 7 presents the data in Table 4 with the addition of the pore fractions Pt and Pb and the Pt/Pb ratio, and the comparative results of the tape peeling test and the sound pressure test. The evaluation was performed in three grades (○: the sample had a sound pressure slope of more than 1.0 and was not peeled by the tape peeling test; Δ: the sample had a sound pressure slope of more than 1.0 and was peeled by the tape peeling test; and x: the sample had a sound pressure slope of 1.0 or less).

TABLE 7

| Sample No. | Immersion time in nitric acid min | Au/ (Au + Cu) at. % | Pore fraction Pt on front surface side vol % | Pore fraction Pt on back surface side vol % | Pt/Pb | Resistance Ω | Sound pressure slope | Evaluation |
|---|---|---|---|---|---|---|---|---|
| 11 | 0 | 25% | — | — | — | 0.35 | 0.8 | x |
| 12 | 5 | 50% | 56.0% | 27.8% | 2.01 | 0.51 | 1.6 | ○ |
| 2 | 20 | 76% | 60.5% | 56.8% | 1.06 | 0.71 | 2.1 | ○ |
| 13 | 40 | 95% | 66.1% | 64.2% | 1.03 | 0.80 | 2.5 | ○ |
| 14 | 60 | 97% | 66.3% | 65.0% | 1.02 | 0.82 | 2.4 | Δ |

In sample No. 11, which was not immersed in nitric acid (immersion time: 0 min), Cu did not leach out, and thus no porous structure was formed, resulting in low sound pressure. In sample No. 14, in which Au was 97 at %, the sound pressure was high, but the sample was peeled by the tape peeling test. Accordingly, the sample was evaluated as Δ. For example, as illustrated in FIG. 8, when the pore fraction Pb is high in the back surface region on the substrate side, the contact area between the heat-generating layer and the substrate is small, resulting in low adhesion strength. In detail, when the Pt/Pb ratio is 2.0 or less, the sound pressure is high. When the Pt/Pb ratio is 1.03 or more, a device that provides high sound pressure and that is not peeled by the tape peeling test can be obtained.

Figure 14:
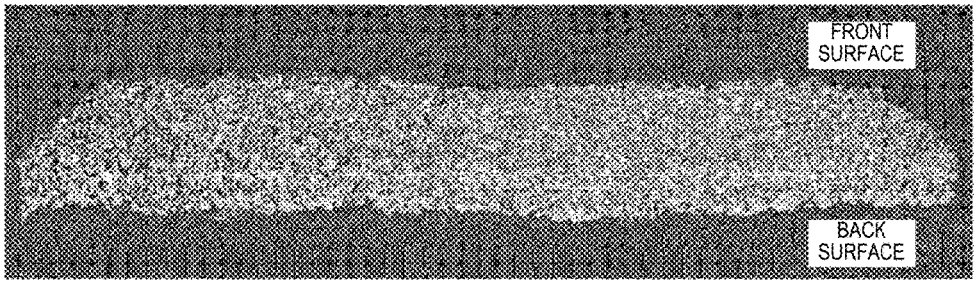
FIG. 14 is a three-dimensional image of the heat-generating layer of sample No. 2.
Figure 15:
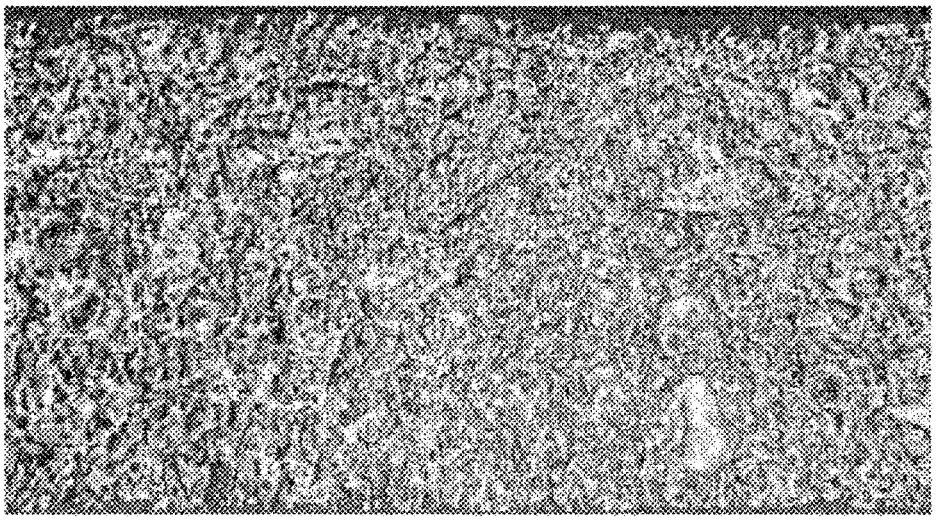
FIG. 15 is a top view illustrating a front surface image obtained from the three-dimensional image of the heat-generating layer of sample No. 2.
Figure 16:
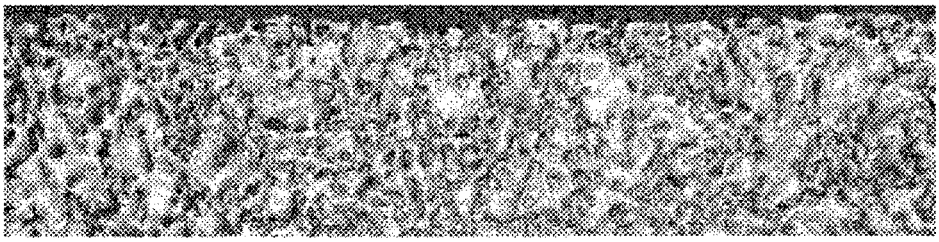
FIG. 16 is a bottom view illustrating a back surface image obtained from the three-dimensional image of the heat-generating layer of sample No. 2.

FIG. 14 is a three-dimensional image of the heat-generating layer of sample No. 2. FIG. 15 is a top view illustrating a front surface image obtained from the three-dimensional image of the heat-generating layer of sample No. 2. FIG. 16 is a bottom view illustrating a back surface image obtained from the three-dimensional image of the heat-generating layer of sample No. 2. In sample No. 2, the pore fraction Pt in the front surface region was large, and high sound pressure was obtained. The pore ratio Pb of the back surface region was small, and a part of the back surface region did not become porous, thus maintaining the adhesion strength with the substrate.

As described above, when the Pt/Pb ratio is 1.2 to 2.0, high sound pressure is obtained. When the Pt/Pb ratio is in the range of 1.03 to 2.0, high sound pressure is obtained, and good adhesion strength of the heat-generating layer is obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The present invention provides a pressure wave-generating device having improved sound pressure and appropriate electrical resistance and thus is extremely useful in industry.

REFERENCE SIGNS LIST

1 pressure wave-generating device
10 support
11 substrate
12 heat-insulating layer
20 heat-generating layer
21 underlying film
22 heating element film
30 electrode structure
31 to 33 electrode layer
D1 and D2 electrode

The invention claimed is:

1. A pressure wave-generating device, comprising:

a support; and a heating element film disposed over the support and configured to generate heat by energization, the heating element film having a porous metal structure.

wherein when the heating element film is divided into a back surface region located on a support side from a thickness center and a front surface region located across the thickness center from the support side, a Pt/Pb ratio of a pore fraction Pt of the front surface region to a pore fraction Pb of the back surface region is 1.02 to 2.01.

2. The pressure wave-generating device according to claim 1, wherein the heating element film has a pore diameter of 25.3 nm to 126 nm.

3. The pressure wave-generating device according to claim 1, wherein the heating element film has a pore fraction of 50.1% to 66.2% by volume.

4. The pressure wave-generating device according to claim 1, wherein the heating element film has a pore fraction of 50.1% to 65.1% by volume.

5. A pressure wave-generating device according to claim 1, wherein the heating element film has a thickness of 25 nm to 1,000 nm.

6. The pressure wave-generating device according to claim 1, wherein the heating element film is composed of two or more metals.

7. The pressure wave-generating device according to claim 6, wherein a proportion of a major element in the two or more metals is 50 to 95 at %.

8. A pressure wave-generating device comprising:

a support; and a heating element film disposed over the support and configured to generate heat by energization, the heating element film having a porous meteral structure, wherein when the heating element film is divided into a back surface region located on a support side from a thickness center and a front surface region located acrose the thickness center from the support side, a Pt/Pb ratio of a pore fraction Pt of the front surface region to a pore fraction Pb of the back surface region is 1.03 to 2.00.

9. A pressure wave-generating device comprising:

a support; and a heating element film disposed over the support and configured to generate heat by energization, the heating element film having a porous metal structure, wherein the support includes a substrate, and the pressure wave-generating device further comprises:

a heat-insulating layer between the substrate and the heating element film, the heat-insulating layer having a lower thermal conductivity than the substate, and wherein the heat-insulating layer has a thermal conductivity of 1.4 W/(m K) or less.

10. The pressure wave-generating device according to claim 9, wherein the heating element film has a pore diameter of 25.3 nm to 126 nm.

11. The pressure wave-generating device according to claim 9, wherein the heating element film has a pore fraction of 50.1% to 66.2% by volume.

12. The pressure wave-generating device according to claim 9, wherein the heating element film has a pore fraction of 50.1% to 65.1% by volume.

13. The pressure wave-generating device according to claim 9, wherein the heating element film has a thickness of 25 nm to 1,000 nm.

14. The pressure wave-generating device according to claim 9, wherein the heating element film is composed of two or more metal.

15. The pressure wave-generating device according to claim 14, wherein a proportion of a major element in the two or more metal is 50 to 95 at %.

* * * * *